US010034528B2

(12) United States Patent
Souza

(10) Patent No.: US 10,034,528 B2
(45) Date of Patent: Jul. 31, 2018

(54) HIGH PERFORMANCE HAIR DRYER

(71) Applicant: ENGEREUS DO BRASIL ENGENHARIA E IND. ELETRO ELETRÔNICA IMPORTAçÃO E EXPORTACAO LTDA, Sao Paulo (BR)

(72) Inventor: Edgar Antonio Figueiredo Souza, Sao Paulo (BR)

(73) Assignee: Engereus Do Brasil Engenharia Industria E Comercio De Electronicos Ltda, Sao Paulo (BR)

( * ) Notice: Subject to any disclaimer, the term of this patent is extended or adjusted under 35 U.S.C. 154(b) by 586 days.

(21) Appl. No.: 14/503,477

(22) Filed: Oct. 1, 2014

(65) Prior Publication Data

US 2015/0237984 A1 Aug. 27, 2015

(30) Foreign Application Priority Data

Feb. 26, 2014 (BR) ..... 102014004615

(51) Int. Cl.

| | |
|---|---|
| ***A45D 20/12*** | (2006.01) |
| ***A45D 20/10*** | (2006.01) |
| *A45D 20/00* | (2006.01) |

(52) U.S. Cl.

CPC ..... *A45D 20/10* (2013.01)

(58) Field of Classification Search

CPC ..... F04D 17/025; F04D 29/281; F04D 29/325–29/328

USPC ..... 34/96, 97, 283; 416/175, 203, 200 R, 416/201 A, 198 R; 415/199.4, 199.6

See application file for complete search history.

(56) References Cited

U.S. PATENT DOCUMENTS

| | | | | |
|---|---|---|---|---|
| 4,596,921 | A * | 6/1986 | Hersh | A45D 20/10 181/225 |
| 5,256,061 | A * | 10/1993 | Cress | F27B 5/04 34/242 |
| 2007/0154314 | A1* | 7/2007 | Jarrah | F04D 29/327 416/203 |
| 2009/0188126 | A1* | 7/2009 | Gaillard | A45D 20/12 34/97 |
| 2010/0064542 | A1* | 3/2010 | Mulvaney | A45D 20/12 34/97 |
| 2013/0133218 | A1* | 5/2013 | Hadden | A45D 20/12 34/97 |

* cited by examiner

*Primary Examiner* — John McCormack

(74) *Attorney, Agent, or Firm* — Troutman Sanders LLP; Ryan A. Schneider

(57) ABSTRACT

A high performance hair dryer with a low level of noise emission and greater energy efficiency due to improvements on the aerodynamic performance. The hair dryer has a functional core with specific aerodynamic features. Between the core and the external casing, material for thermal-acoustic insulation can be inserted. Within the core, a conventional or mixed type impeller can be inserted.

19 Claims, 9 Drawing Sheets

HIGH PERFORMANCE HAIR DRYER

CROSS REFERENCE TO RELATED APPLICATIONS

This application claims the benefit of BR 10 2014 004615-1, filed 26 Feb. 2014, herein fully incorporated by reference.

BACKGROUND OF THE INVENTION

1. Field of the Invention

This invention relates to a high performance hair dryer with a low level of noise emission, increase of energy efficiency due to improvements on the aerodynamic performance and improvements resulting of the use of a mixed flow impeller, in other words, radial part and axial part.

2. Description of Related Art

Inside these fans, the airflow is turbulent, what causes the dryer to emit noise during the operation. In some cases, the noise is elevated, what brings discomfort to users, or even hearing health problems.

Due to that, a hair dryer that improves the airflow inside the casing of the dryer was developed, reducing the level of noise emitted during the operation of the equipment. The change of the internal system of the impeller does not affect the external features of the dryer.

Ordinary hair dryers work with an impeller positioned inside its casing, what causes the internal airflow. The impeller draws the air through the back part of the dryer, driving it to the front part. The air, after passing by the fan, crosses an electric resistance that heats it. Thus, the air comes out of the dryer on high speed and heated. The heated air allows accelerating the air evaporation process and moisture removal of the wet hair, such as modeling and conforming the hair.

Home dryers use impellers of the axial type, which draws and impels the air on the parallel direction to the rotation axis. Axial impellers have low compression ability, are used in dryers with low airflow, and power output. In this assembly, the airflow proportionally increases with the increase of rotation of the impeller, until a limit of maximum airflow, where the stalling occurs. From this rotation, any increase on the rotation does not bring any increase to the flow, but it will generate more turbulence and vortexes, what cause noise.

Professional hair dryers, on other hand, require a greater airflow and compression using radial impeller, which draw the air on parallel direction and impel it on the perpendicular direction to the rotation axis.

With the radial impellers, stalling is reduced due to the air being propelled by centrifugal force, thus, impellers can work with greater rotation and, therefore, generate a greater airflow.

Further, there are spiral impellers that draw the air by the sides and tangentially impel the air to the direction of the rotation, to the front of the hair dryer. In this case, the motor and impeller are perpendicularly mounted to the airflow. These impellers are disused and its operating principle is very similar to radial impellers.

BRIEF SUMMARY OF THE INVENTION

Briefly described, in preferred form, the present invention comprises a high performance hair dryer with a low level of noise incorporating a high performance insulating core, mounted within a hair dryer casing, with air flow generated by the rotation of an impeller positioned within the core, wherein said core is comprised by an air inlet, a flow driver, a motor fairing, an inner fairing, motor and resistive element.

The impeller can be of the mixed type with big fins and small fins, which generates an air flow when rotating on the axial direction that passes through the flip gap of the flow driver, being the said impeller, along with other components, mounted within a core of the dryer.

The internal casing can have an acoustic insulating area that absorbs noise and vibrations generated by the motor, by the impeller and by the airflow.

The mixed impeller can be made of thermoplastic material by injection, machining process or mounted in combination by specific parts.

The functional core can be manufactured separately or integrally to the external casing.

The core and the external casing can be separated by an insulating chamber for thermal and acoustic insulation, being this chamber filled with insulating materials, such as rock wool, elastomers or expanded plastics.

The insulating chamber need not be filled with insulating material.

BRIEF DESCRIPTION OF THE DRAWINGS

Various features and advantages of the present invention may be more readily understood with reference to the following detailed description taken in conjunction with the accompanying drawings, wherein like reference numerals designate like structural elements, and in which.

DETAILED DESCRIPTION OF PREFERRED EMBODIMENTS

Figure 1:
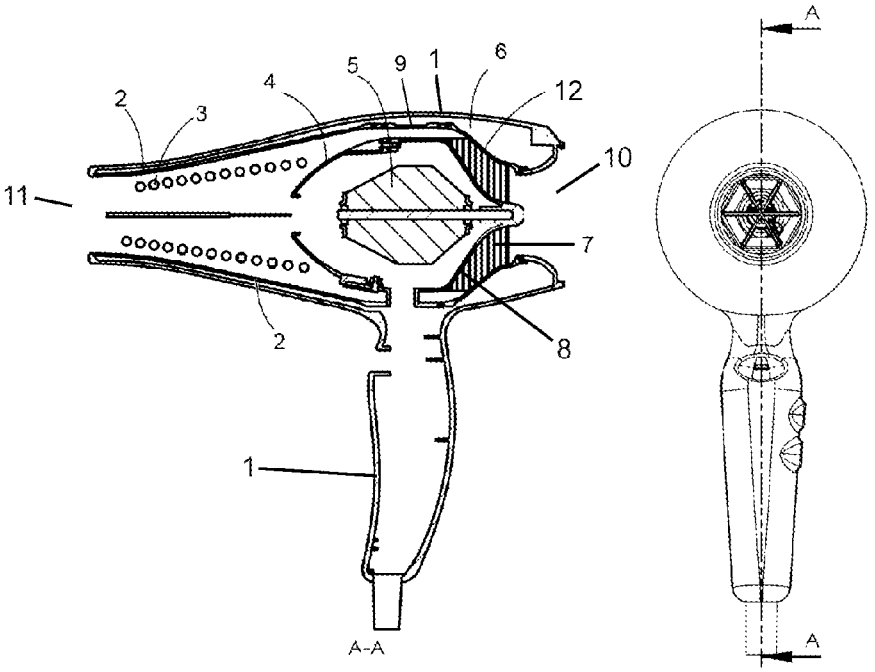
FIG. 1 shows the front view and the cross-section of the high performance hair dryer, with details of components of the core mounted within the casing 1 of the high performance hair dryer.

To facilitate an understanding of the principles and features of the various embodiments of the invention, various illustrative embodiments are explained below. Although exemplary embodiments of the invention are explained in detail, it is to be understood that other embodiments are contemplated. Accordingly, it is not intended that the invention is limited in its scope to the details of construction and arrangement of components set forth in the following description or examples. The invention is capable of other embodiments and of being practiced or carried out in various ways. Also, in describing the exemplary embodiments, specific terminology will be resorted to for the sake of clarity.

It must also be noted that, as used in the specification and the appended claims, the singular forms "a," "an" and "the" include plural references unless the context clearly dictates otherwise. For example, reference to a component is intended also to include composition of a plurality of components. References to a composition containing "a" constituent is intended to include other constituents in addition to the one named.

Also, in describing the exemplary embodiments, terminology will be resorted to for the sake of clarity. It is intended that each term contemplates its broadest meaning as understood by those skilled in the art and includes all technical equivalents which operate in a similar manner to accomplish a similar purpose.

Ranges may be expressed herein as from "about" or "approximately" or "substantially" one particular value and/or to "about" or "approximately" or "substantially" another particular value. When such a range is expressed, other exemplary embodiments include from the one particular value and/or to the other particular value.

Similarly, as used herein, "substantially free" of something, or "substantially pure", and like characterizations, can include both being "at least substantially free" of something, or "at least substantially pure", and being "completely free" of something, or "completely pure".

By "comprising" or "containing" or "including" is meant that at least the named compound, element, particle, or method step is present in the composition or article or method, but does not exclude the presence of other compounds, materials, particles, method steps, even if the other such compounds, material, particles, method steps have the same function as what is named.

It is also to be understood that the mention of one or more method steps does not preclude the presence of additional method steps or intervening method steps between those steps expressly identified. Similarly, it is also to be understood that the mention of one or more components in a composition does not preclude the presence of additional components than those expressly identified.

The materials described as making up the various elements of the invention are intended to be illustrative and not restrictive. Many suitable materials that would perform the same or a similar function as the materials described herein are intended to be embraced within the scope of the invention. Such other materials not described herein can include, but are not limited to, for example, materials that are developed after the time of the development of the invention.

FIG. 1 presents the front view and cross-section of the hair dryer. Air is drawn through the air inlet 10, and aspirated by the impeller 8 that is rotated by the electric motor 5 positioned within the engine fairing 4. Thereat, an air flow is generated in the compression area 7, which flows through the inner cavities of the flow driver 9 until it crosses the resistive elements 3 positioned within the inner fairing 2. The air comes out, heated, by the air outlet 11. This system is built within the casing 1 and it is insulated, acoustically, by an acoustic insulation region 6. The small and large blades the impeller 8 occupies the same area of the compression region 7.

Figure 2:
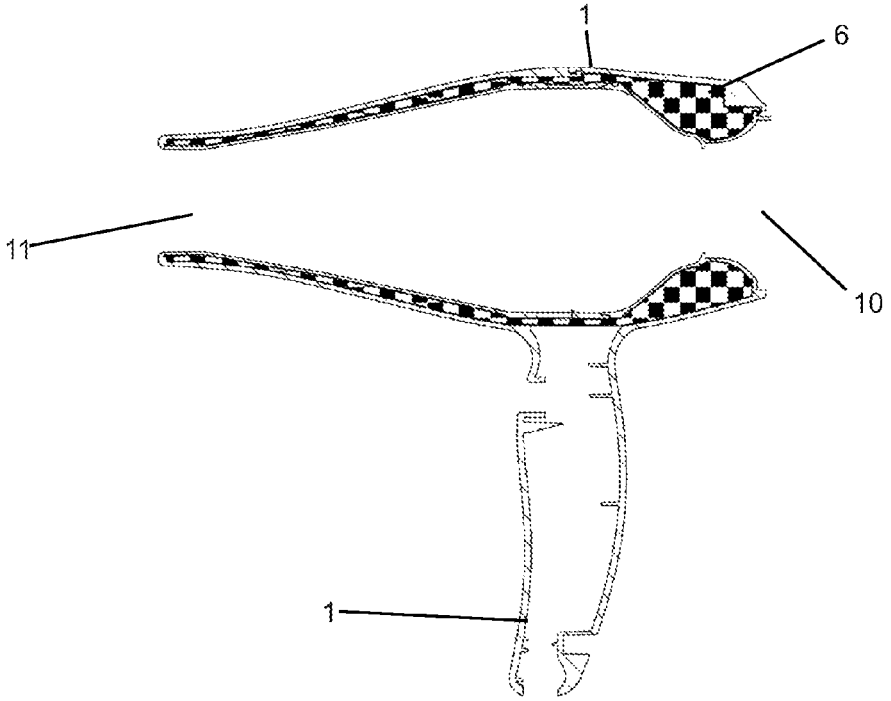
FIG. 2 shows the cross-section, according to the indication of FIG. 1, of the casing 1 of the high performance hair dryer, with emphasis on the insulating chamber 6 formed between the casing and the core of the dryer.

FIG. 2 shows, on the cross-section of the casing 1 of the high performance hair dryer, the air inlet 10, the air outlet 11, with emphasis on the insulating chamber 6 formed between the casing and the hair dryer core. This chamber is a thermal-acoustic insulator on the hair dryer.

Figure 3:
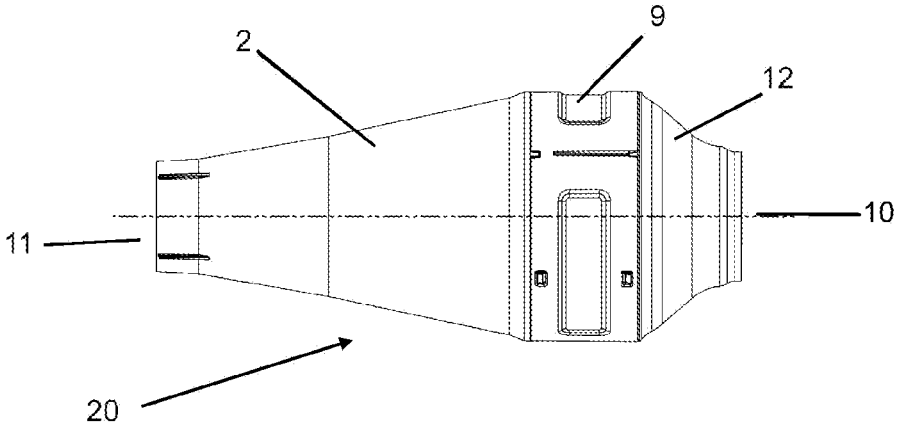
FIG. 3 shows the core 20 of the high performance hair dryer.

FIG. 3 presents the core 20 of the high performance hair dryer with the cold air inlet 10 and the heated air outlet 11.

Figure 4:
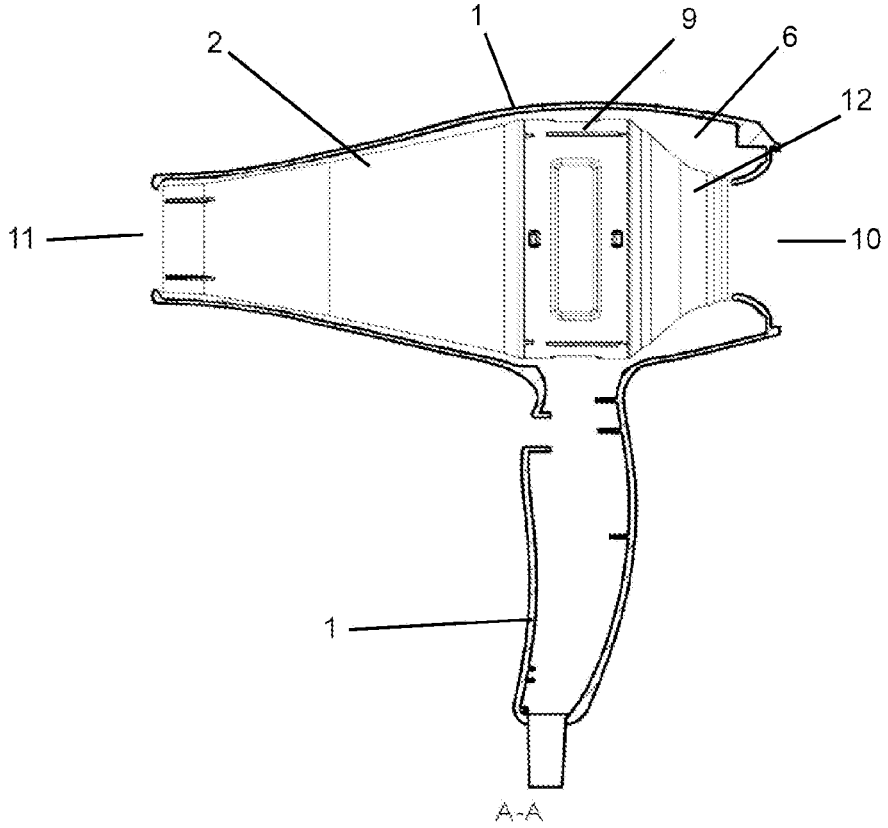
FIG. 4 shows the partial cross-section, according to indicated on FIG. 1, where is possible to see the core 20 system of the high performance hair dryer within the casing 1 and basic parts that comprise the core 20 of the hair dryer, being, respectively, air inlet 12, flow director 9 and inner fairing 2.

FIG. 4 shows a partial cross-section of the high performance hair dryer, according to indicated on FIG. 1, highlighting the core 20 mounted within the casing of the hair dryer. In this view, besides the cold air inlet 10 and hot air outlet 11, one can see the external parts of the functional core of the hair dryer, which are: air inlet 12, motor fairing 4, flow driver 9 and inner fairing 2.

Figure 5:
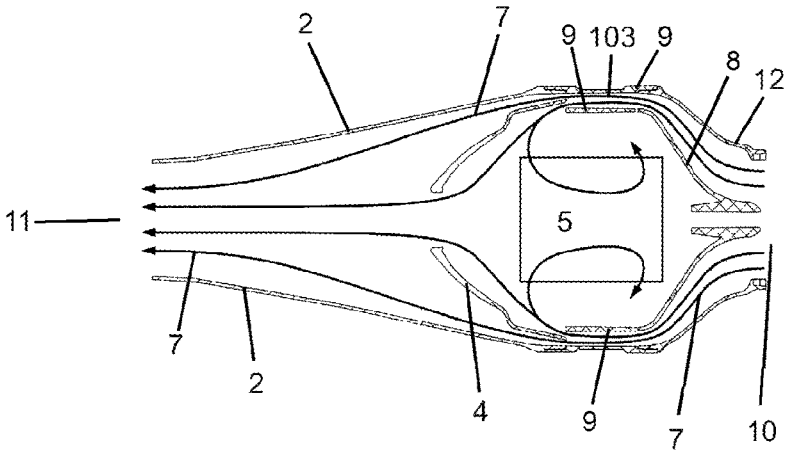
FIGS. 5-6 show, respectively, the airflow within the core 20 of the hair dryer and the airflow alignment scheme within the flow driver 9.

FIG. 5 presents a schematic drawing of the airflow within the core 20 of the high performance hair dryer. Highlighting the electric motor 5, mounted within the motor fairing 4, which spins the impeller 8 positioned within the air inlet 12 causing an air flow on the compression area 7, this compressed air, flows through the flow driver 9, passing by the inner fairing 2 until the air outlet 11. For cooling the motor, part of the airflow 7 impelled forth is deflected inside the motor fairing 4.

Figure 6:
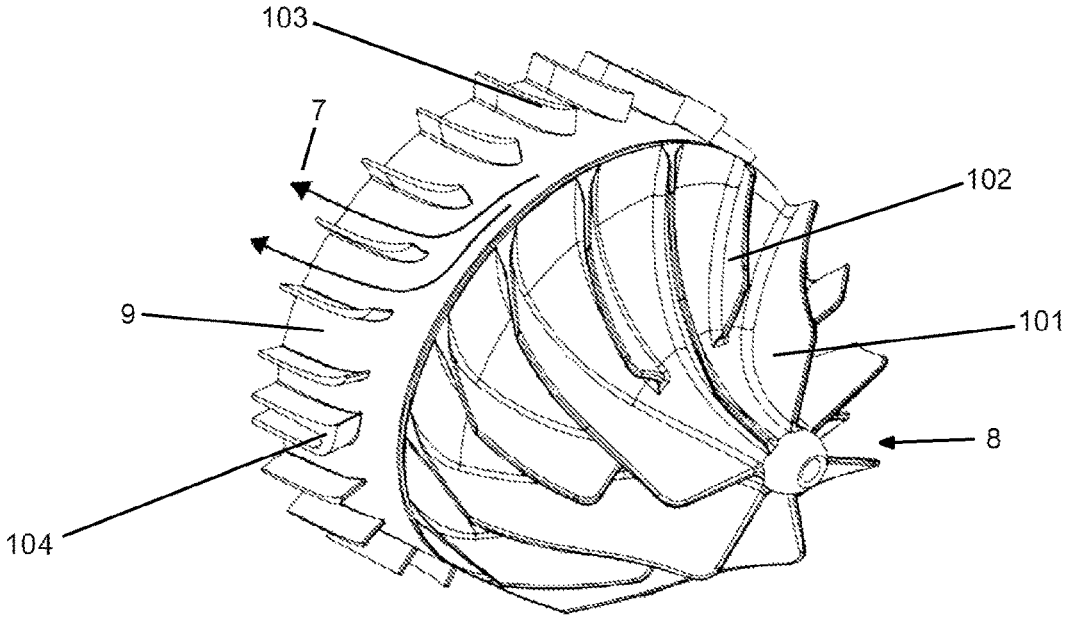

FIGS. 5 and 6 show, respectively, the airflow within the core of the hair dryer and the airflow alignment scheme within the flow driver.

FIG. 6 presents an inner view of the flow aligner 9 and the mixed impeller 8. When impelled by big 101 and small 102 flips, the air tends to come out with a rotation movement adverse to the flow. In this view, one can note the airflow alignment 7 when passing by the channels between flips 103 and 104 of the flow driver 9.

Figure 7:
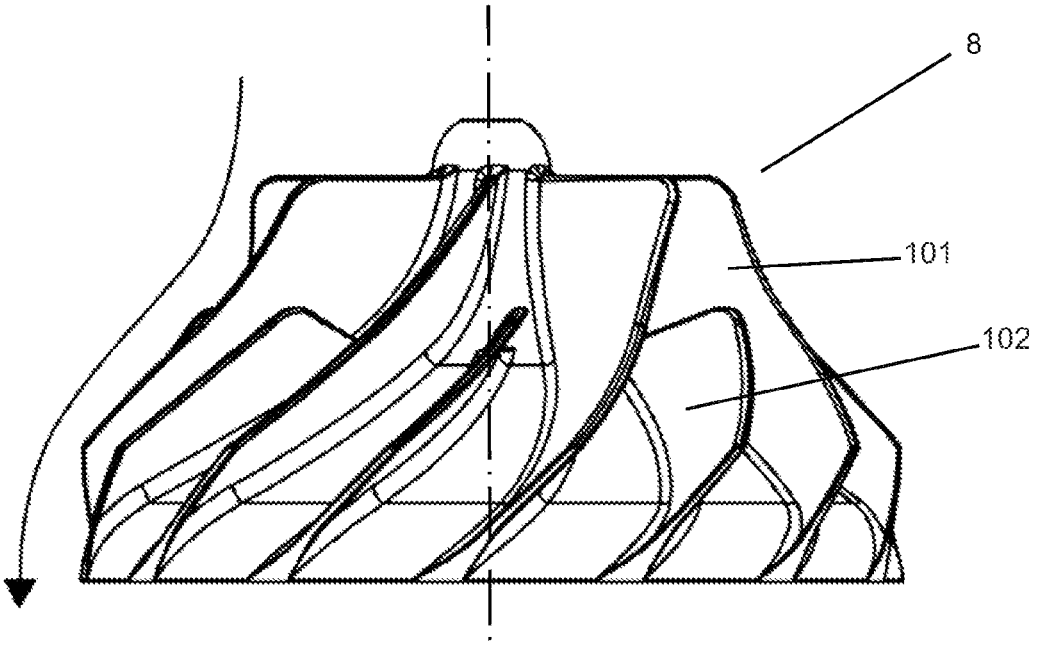
FIGS. 7-9 show, respectively, the side, front and isometric views of the present high performance hair dryer impeller.

FIG. 7 shows the side view of the mixed impeller of the present high performance hair dryer.

Figure 8:
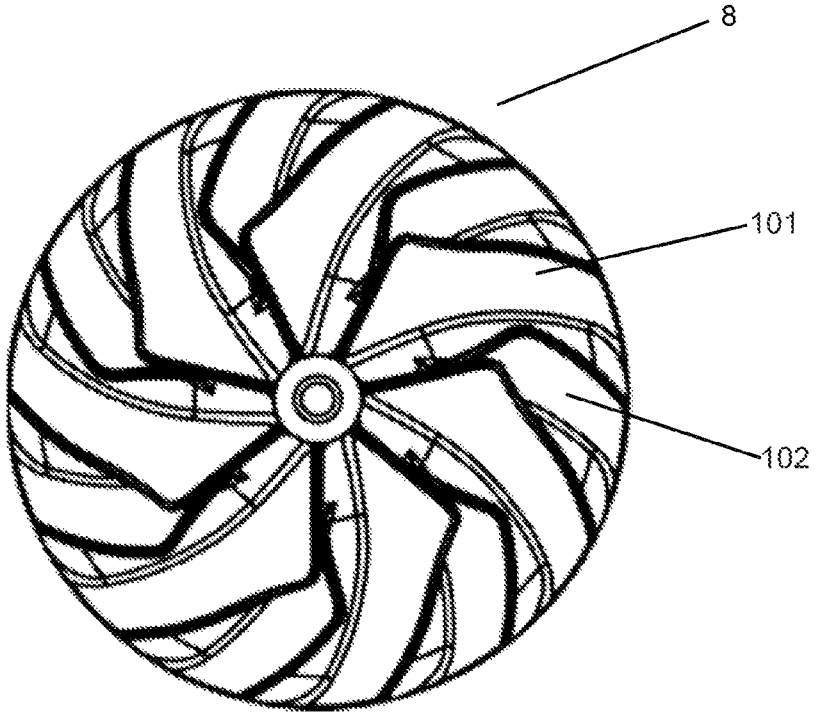

FIG. 8 shows the front view of the mixed impeller of the present high performance hair dryer.

Figure 9:
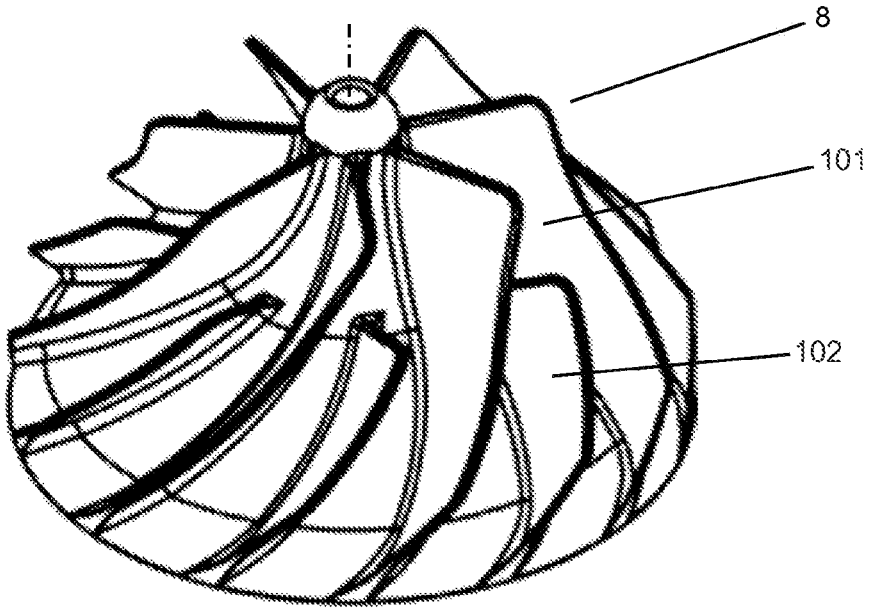
Figure 10:
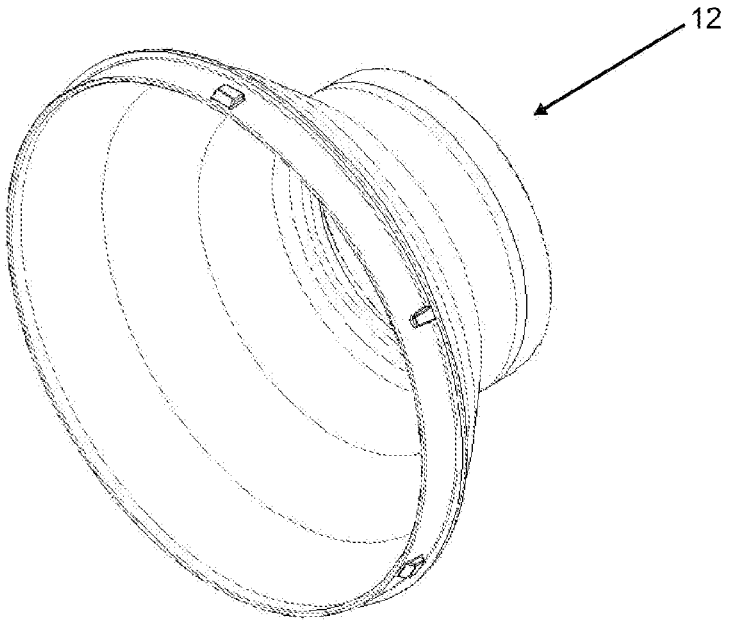
FIGS. 10-13 show the parts that comprise the core of the hair dryer, being, respectively, air inlet 12, motor fairing 4, flow driver 9 and inner fairing 2.
Figure 11:
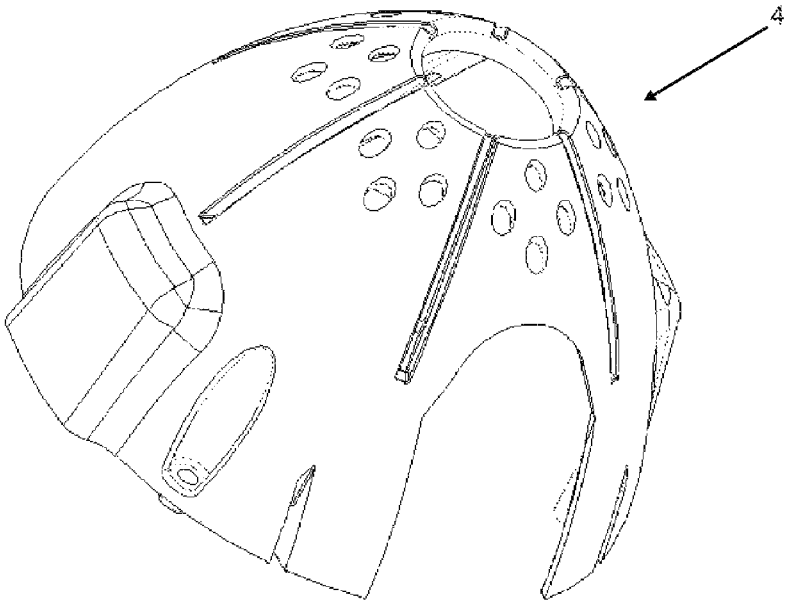
Figure 12:
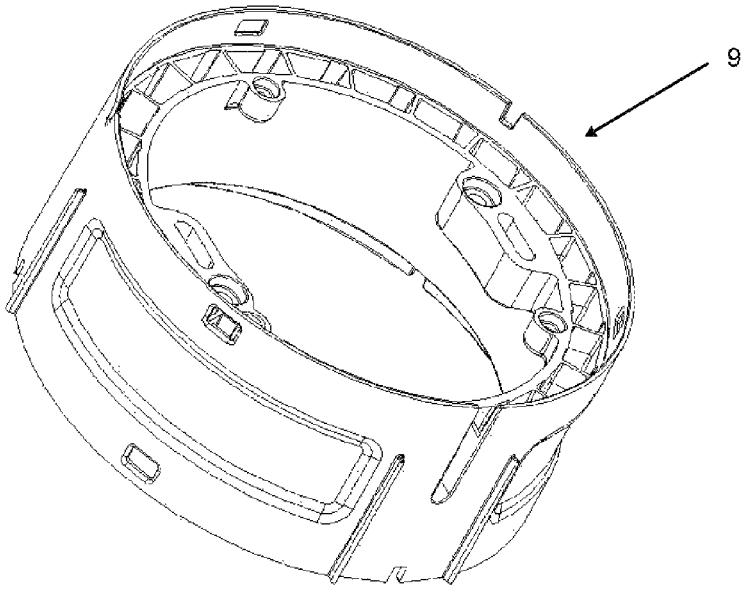
Figure 13:
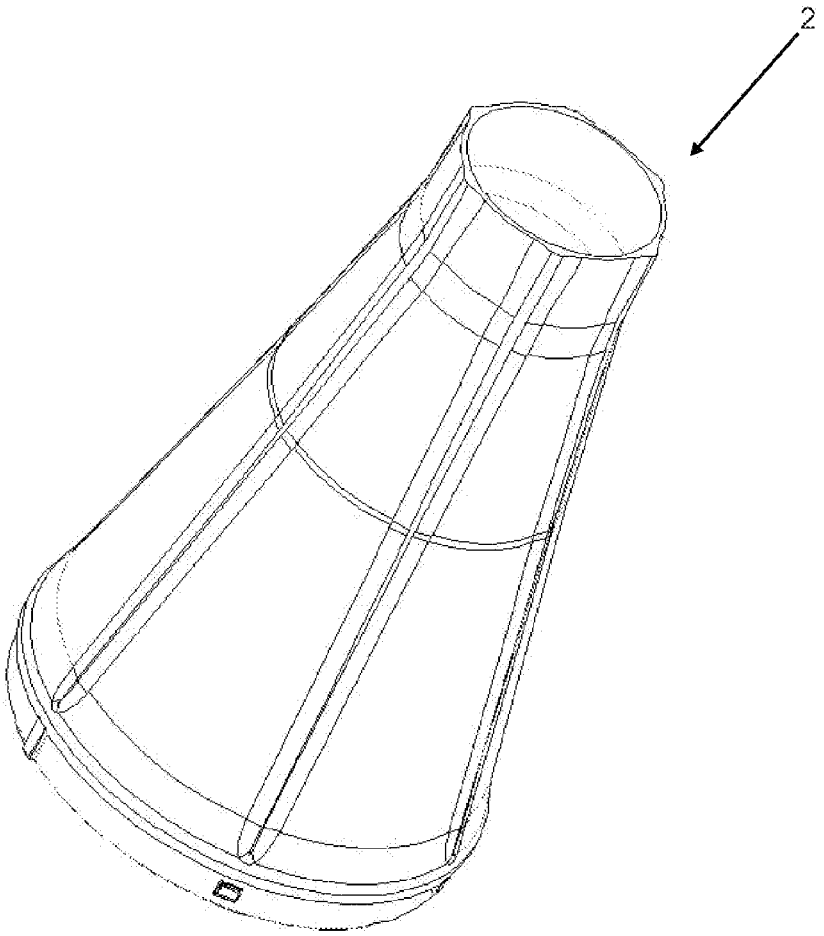

FIG. 9 shows the isometric view of the mixed impeller of the present high performance hair dryer.

FIGS. 10, 11, 12 and 13 show the parts that comprise the core of the hair dryer, being, respectively, air inlet 12, motor fairing 4, flow driver 9 and inner fairing 2.

Figure 14:
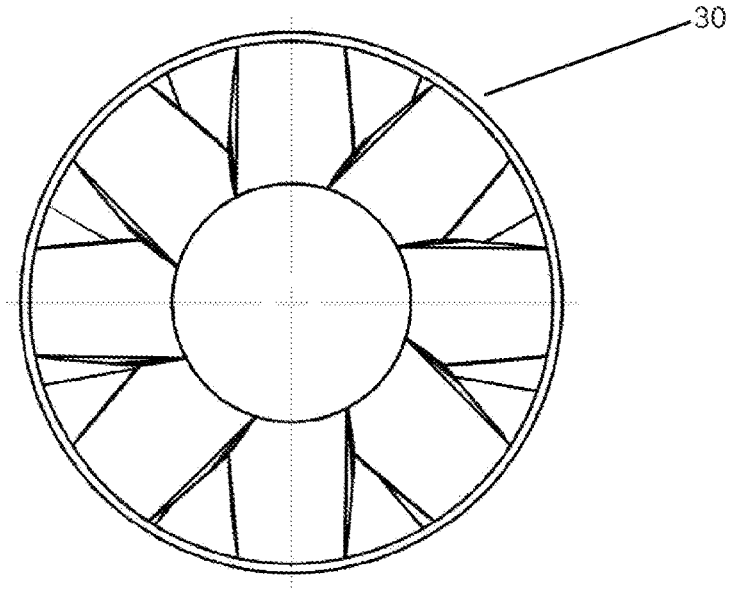
FIGS. 14-15 show a front and side view of an axial impeller of an ordinary hair dryer.
Figure 15:
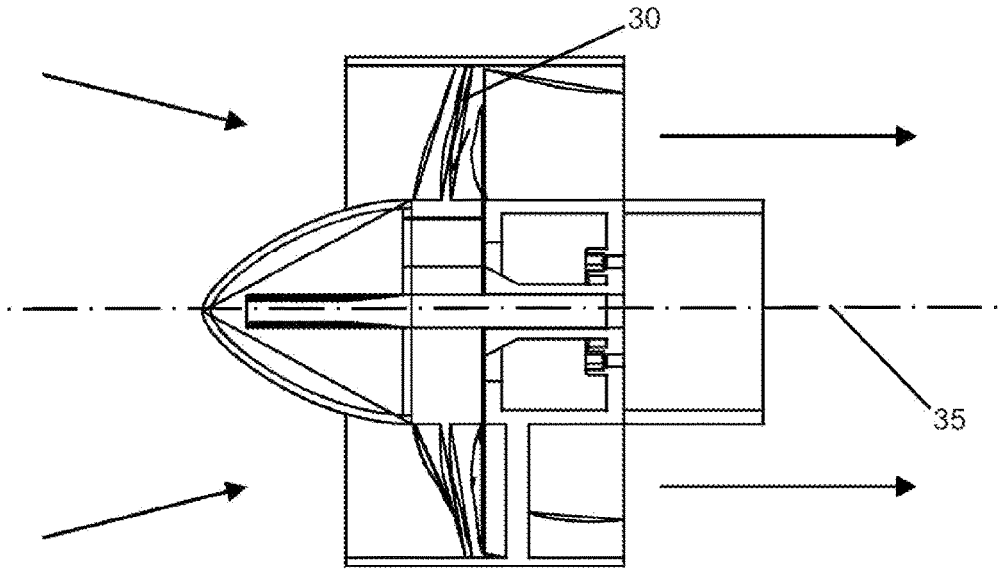

FIGS. 14 and 15 show a front and side view of an axial impeller of an ordinary hair dryer.

Figure 16:
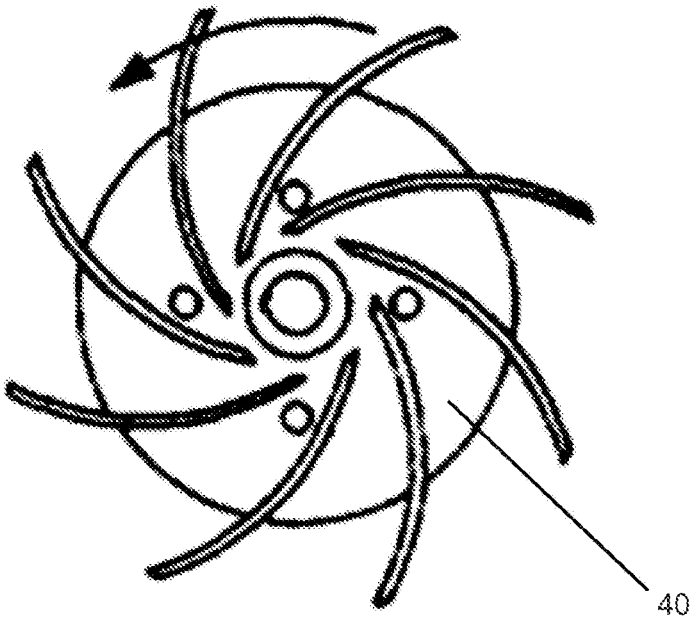
FIG. 16 shows a schematic front view of the radial impeller of an ordinary hair dryer.

FIG. 16 shows the front view of a radial impeller 40 that, when spinning, causes an airflow on the perpendicular direction of the rotation axis.

The present model of high performance hair dryer is mounted with a mixed flow impeller, because it presents features from both an axial and a radial impeller.

This impeller operates in three stages.

On the first, the air is drawn with a parallel flow to the rotation axis. On the second, the airflow runs on the perpendicular direction to the axis radial direction, which compresses the air. On the third and last stage, the airflow is impelled on the parallel direction to the rotation axis, driving the flow to the front side of the hair dryer.

In the end, the airflow caused by the impeller has a parallel direction to the rotation axis. However, the airflow, on the impeller outlet, has a significant component of tangential displacement to the rotation axis, which is converted in parallel or axial flow with the use of static 103 and 104 flips within the flow driver 9.

The impeller is manufactured by the plastic injection process, since that its format was set after wide studies and aerodynamic performance tests.

The mixed flow impeller 8 and static flips 103 were designed with the aid of compressor conception and optimizing software, and its forms and surfaces were generated by algorithms fed by using conditions, such as motor rotation, power, diameter, desired rate of compression and flow.

In a subsequent step, the impeller was adapted to the injection process, where it kept the inclination angle of the fins constant to enable the injection process and extraction of the mold.

As the results of aerodynamic computer simulations are not accurate, tens of prototypes of impellers with small variations on the inclination angles, surface area and number of fins of the impeller were made, until it reached the chosen set of features.

In the performance tests, the hair dryer with the present architecture has its supply voltage reduced to the point where its flow is equal to other existing models, and then it has its noise emission measured. The noise was measured in decibel scale, a logarithmic scale.

The percentage difference of sound power, shown on the Table 1, is guided by Equation 1:

$$P_{dB} - P_{dB_o} = 10 \cdot \log_{10}\left(\frac{W}{W_o}\right) \tag{1}$$

Where $P_{dB_o}$ and $P_{dB}$ are the powers of the present invention and compared hair dryer only, respectively, in decibel scale.

W and $W_o$ are, respectively, the absolute sound powers of the compared dryer and the reference one, in this case, the present one.

When rewriting Equation 1 with the antilogarithm, one can determine the absolute sound power ratio:

$$\left(\frac{W}{W_o}\right) = 10^{\left(\frac{(P_{dB} - P_{dB_o})}{10}\right)} \tag{2}$$

The percent ratio may then be given by Equation 3:

$$\left(\frac{W}{W_o}\right)\% = \left(10^{\left(\frac{(P_{dB} - P_{dB_o})}{10}\right)} - 1\right) * 100 \tag{3}$$

To keep the motor and electric resistance in its positions within the hair dryer casing, supports are built. These supports and the inner electrical wiring obstruct the airflow generated by the impeller.

In the present invention, supports were used on the stator, which provide mechanical sustaining to the motor, with an aerodynamic format. The aerodynamic form of these supports, besides minimizing the creation of vortexes and aerodynamic dragging, help to guide the flow generated on the impeller from the tangential to the axial direction, thus helping the flow increase with the noise decrease.

Another limitation to the airflow is caused by imperfections within the casing, with the formation of rungs or corners.

These imperfections are eliminated, or at least minimized, with the enclosure of the engine and its wiring in fairings 4 within the hair dryer core. This way, rungs are eliminated and the abrupt variation of the size of the cross-section is smoothed along the inner part of the casing.

Finally, the inner set, named hair dryer core in FIGS. 3 and 4 is positioned within the external casing of the hair dryer 1. The core and casing are separated by air or materials that absorb vibrations, such as elastomers or other insulating material. Thereat, the noise propagated and emitted to the external medium is significantly reduced.

Noise Test for a Same Flow in Different Hair Dryers

In this comparative test, the hair dryer with the present architecture has its supply voltage reduced to the point where its flow is equal to the competitors, and then it has its noise emission measured.

| Comparison model | Air flow (liters/s) | Side noise (dBA 31 cm) | Back noise (dBA 31 cm) | Average noise reduction (dBA) | Sound Power Percentage Difference |
|---|---|---|---|---|---|
| model 1 | 28.30 | 68.3 | 72.8 | 2.2 | 65.96% |
| model 2 | 22.61 | 69.5 | 74 | 5 | 216.23% |
| model 3 | 24.18 | 70.3 | 74.9 | 3.05 | 101.84% |
| model 4 | 25.31 | 65.8 | 70.7 | 6.75 | 373.15% |
| model 5 | 20.76 | 72 | 76.2 | 2.4 | 73.78% |
| model 6 | 27.59 | 71.5 | 75 | 6 | 298.11% |
| model 7 | 26.74 | 74.7 | 79.3 | 3.05 | 101.84% |
| | | Average reduction | | 4.06 | |

Equaling the flow generated by the manipulation of the supply voltage of the present high performance hair dryer, is possible to confirm a better aero-acoustic performance for the same flow, when compared to other existing models that emit an average of 4.06 dB, which corresponds to a sound power 155 times greater than the generated by the present model.

In view of our experiments, specially the exposed herein, we proved that the present high performance hair dryer presents advantages to users, being considered an advance over the current state of the art.

While particular embodiments have been described in this description, it is to be understood that other embodiments are possible and that the invention is not limited to the described embodiments and instead are defined by the claims.

What is claimed is:

1. A hair dryer comprising:

a hair dryer casing;

an insulating core mounted within the hair dryer casing; and an impeller positioned within the insulating core;

wherein air flow is generated by the rotation of the impeller;

wherein the insulating core comprises an air inlet, an air outlet, a flow driver, a motor fairing, an inner fairing, a motor, and a resistive element;

wherein the air flow at the air inlet and the air outlet are substantially parallel to the longitudinal axis of the hair dryer casing; and wherein the impeller is configured to draw the air flow in substantially parallel to the longitudinal axis of the hair dryer casing, change the air flow to substantially perpendicular to the longitudinal axis of the hair dryer casing, and then change the air flow to substantially parallel to the longitudinal axis of the hair dryer casing.

2. The hair dryer of claim 1, wherein the impeller comprises a set of first fins and a set of second fins, the first and second fins having a different size from one another, the first and second fins generating an air flow when rotating on an axial direction that passes through a flip gap of the flow driver.

3. The hair dryer of claim 1, wherein the hair dryer casing comprises an acoustic insulating area that absorbs an amount of one or both of noise and vibrations.

4. The hair dryer of claim 1, wherein the impeller comprises thermoplastic material.

5. The hair dryer of claim 1, wherein the impeller consists of thermoplastic material.

6. The hair dryer of claim 1 further comprising an insulating chamber located between the hair dryer casing and the insulating core.

7. The hair dryer of claim 6, wherein the insulating chamber is filled with insulating material that absorbs an amount of one or both of noise and heat.

8. The hair dryer of claim 7, wherein the insulating material comprises rock wool.

9. The hair dryer of claim 7, wherein the insulating material comprises elastomers.

10. The hair dryer of claim 7, wherein the insulating material comprises expanded plastics.

11. The hair dryer of claim 6, wherein the insulating chamber is not filled with insulating material.

12. The hair dryer of claim 1, wherein the hair dryer casing comprises an annular hair dryer casing having an air inlet end having at least a portion of which is unobstructed to an air flow entering the air inlet end substantially parallel to the longitudinal axis of the hair dryer casing.

13. The hair dryer of claim 2, wherein the flow driver comprises a plurality of static flips configured to direct the air flow in a direction substantially parallel to the longitudinal axis of the hair dryer casing.

14. A hair dryer comprising:

an annular hair dryer casing having a longitudinal axis and open ends, an inlet end and an outlet end;

an insulating core mounted within the annular hair dryer casing and between the open ends;

an annular insulating chamber located between the annular hair dryer casing and the insulating core; and an impeller positioned within the insulating core;

wherein air flow is generated by the rotation of the impeller;

wherein the impeller is configured to draw the air flow in substantially parallel to the longitudinal axis of the annular hair dryer casing, change the air flow to substantially perpendicular to the longitudinal axis of the annular hair dryer casing, and then change the air flow to substantially parallel to the longitudinal axis of the annular hair dryer casing;

wherein the dimensions of the annular hair dryer casing and annular insulating chamber maintaining the open ends of the annular hair dryer casing such that air flow into the inlet end of the annular hair dryer casing and the air flow out of the outlet end of the annular hair dryer casing are both substantially parallel to the longitudinal axis of the annular hair dryer casing;

wherein the insulating core comprises an air inlet, a flow driver, a motor fairing, an inner fairing, a motor, and a resistive element;

wherein the impeller comprises a set of first fins and a set of second fins, the first and second fins having a different size from one another, the first and second fins generating an air flow when rotating on the axial direction that passes through a flip gap of the flow driver; and wherein the annular hair dryer casing comprises an acoustic insulating area that absorbs an amount of one or both of noise and vibrations.

15. The hair dryer of claim 14, wherein the annular insulating chamber is filled with insulating material that absorbs an amount of one or both of noise and heat.

16. The hair dryer of claim 15, wherein the insulating material comprises rock wool.

17. The hair dryer of claim 15, wherein the insulating material comprises elastomers.

18. The hair dryer of claim 15, wherein the insulating material comprises expanded plastics.

19. The hair dryer of claim 14, wherein the flow driver comprises a plurality of static flips configured to direct the air flow in a direction substantially parallel to the longitudinal axis of the annular hair dryer casing.

* * * * *